US005969737A

United States Patent [19]

Koyama et al.

[11] Patent Number: 5,969,737

[45] Date of Patent: Oct. 19, 1999

[54] INK JET RECORDING DEVICE WITH DETACHABLE INK CARTRIDGE AND INK CARTRIDGE THEREOF

[75] Inventors: Kazuya Koyama; Kohji Tsurui; Hajime Horinaka, all of Nara; Masaharu Kimura, Osaka; Hisashi Yoshimura; Hiroshi Kubota, both of Nara, all of Japan

[73] Assignee: Sharp Kabushiki Kaisha, Osaka, Japan

[21] Appl. No.: 08/732,880

[22] Filed: Oct. 16, 1996

[30] Foreign Application Priority Data

Oct. 16, 1995 [JP] Japan ..... 7-267306

[51] Int. Cl.[6] ..... B41J 2/175

[52] U.S. Cl. ..... 347/86; 137/614.05

[58] Field of Search ..... 347/7, 84, 85, 347/86, 87, 92; 137/68.3, 614.05; 251/149.2

[56] References Cited

U.S. PATENT DOCUMENTS 2,206,818 7/1940 Mapes ..... 137/68.3
4,183,031 1/1980 Kyser et al. ..... 347/86
4,627,598 12/1986 Fremy ..... 137/149.2
5,619,238 4/1997 Higuma et al. ..... 347/86

FOREIGN PATENT DOCUMENTS 60-36174 2/1985 Japan .

*Primary Examiner*—N. Le
*Assistant Examiner*—Anh T. N. Vo

[57] ABSTRACT

An ink jet recording device includes a recording head for discharging ink to a recording medium, a recording head side coupling portion coupled with a reservoir chamber side coupling portion to receive supply of ink and providing ink to the recording head. The recording head side coupling portion includes a member with an ink passage and a valve device for opening/closing the ink passage. The valve device begins to open during coupling of the reservoir chamber side coupling portion and the recording head side coupling portion, and closes at complete detachment.

14 Claims, 11 Drawing Sheets

A-A DIRECTION

B-B SECT

C-C DIRECTION

D-D SECT

E-E DIRECTION

F-F DIRECTION

INK JET RECORDING DEVICE WITH DETACHABLE INK CARTRIDGE AND INK CARTRIDGE THEREOF

BACKGROUND OF THE INVENTION

1. Field of the Invention

The present invention relates to ink jet recording devices and ink cartridges. Particularly, the present invention relates to an ink jet recording device with a detachable ink cartridge and the ink cartridge thereof.

2. Description of the Background Art

An ink jet recording device has a disadvantage that the device is contaminated due to exudation of liquid ink used therein. Various devices are implemented as to a means of preventing ink from seeping out. For the purpose of preventing ink exudation particularly when exchanging an ink cartridge, an open/close device is provided at the ink supply path of the ink cartridge coupling portion at the recording head side. The open/close device is open under the state where the ink cartridge is coupled, and closed just before the ink cartridge is detached.

Referring to FIGS. 1 and 2, a conventional ink jet recording device with a detachable ink cartridge disclosed in Japanese Patent Laying-Open No. 60-36174 will be described hereinafter.

Referring to FIG. 1, an ink jet recording device includes a medium to be recorded on (referred to as "recording sheet" hereinafter) 101, a platen 102 driven by a driving source such as a pulse motor not shown to convey recording sheet 101, a recording device main body 121 for discharging ink onto recording sheet 101 to record information, and an ink cassette 107 for supplying ink to the recording device main body 121.

The recording device main body 121 includes an ink jet head unit 103 to discharge ink onto recording sheet 101 for printing, a first tube 104 for supplying ink to ink jet head unit 103, and a joint unit 105 for attaching/detaching ink cassette 107 and recording device main body 121.

Ink jet head unit 103 includes a head unit 103A for discharging ink onto recording sheet 101, and a sub tank 103B for supplying ink to head unit 103A. Ink 103C is accommodated in sub tank 103B.

Referring to FIG. 2, joint unit 105 includes a support unit 110 fixed to recording device main body 121, a second tube 108 of sufficient elasticity, connected to first tube 104 and fixed to support unit 110, a third tube 109 connected to second tube 108, a shaft 112 fixed to recording device main body 121, a lever 111 fitted to shaft 112 to press and block second tube 108 by the elasticity of spring 113, and a pin 106 inserted into third tube 109 and protruding from joint portion 105.

Ink cassette 107 includes a main body 116, an ink tank 118 provided within main body 116 and located several inches below head unit 103A, a tube 117 connected to ink tank 118, and a coupling portion 115 formed of an elastic material such as silicon rubber, connected to tube 117, and coupled to recording device main body 121 by having a pin 106 inserted therein.

Coupling portion 115 includes an ink passage 114 into which pin 106 is inserted for supplying ink.

A claw 111A abutting against a chamfered portion 107A provided at ink cassette 107, and a claw 111B urged against second tube 108 are provided at lever 111. Ink tank 118 is constituted of a flexible material formed by vapor-depositing aluminum on a laminate film, for example.

Since ink tank 118 is flexible and the interior thereof is at atmospheric pressure, the leading end of head 103A is maintained under a slight negative pressure. This prevents ink from leaking from the end of the head. When ink is discharged from head 103A by mechanical force such as a drive by a piezo-electric element, ink tank 118 is deformed according to reduction of ink to supply an appropriate amount of ink to head 103A.

When ink tank 118 becomes empty, ink cannot be discharged from head 103A even if ink remains in sub tank 103B or tube 108. On this occasion, ink cassette 107 must be exchanged. By lifting ink cassette 107 in the direction of arrow X in FIG. 2, claw 111A is detached from cassette 107 with a shifted distance of L2. In response, lever 111 is turned counterclockwise about shaft 112 by spring 113. The tip of claw 111B is urged against tube 108 in the direction of arrow P. Tube 108 is squeezed at the contact point with claw 111B, whereby the ink supply path formed by tube 108 is sealed. Here, a small amount of ink within tube 8 is shifted towards ink passage 114 via pin 106. However, the coupling between ink tank 118 and pin 106 is still maintained since length L1 of pin 106 is L1>L2, so that the ink will not flow backwards outside ink cassette 107 to contaminate the device.

Ink also flows towards the direction of head 103A. However, the provision of a cap device and the like at head 103A prevents ink leakage in the opposite direction. Ink cassette 107 is further moved to be detached from device main body 121, and pin 106 is drawn out from cassette 107. Since tube 108 is sealed by claw 111B, ink will not leak out from tube 108.

The elastic body such as of rubber forming coupling portion 115 has its elastic deformation restored immediately when pin 106 is pulled out. Ink will not leak from ink cassette 107 since coupling portion 117 is sealed. More specifically, the record liquid supply path connecting the recording head and a recording liquid reservoir chamber is blocked just before ink cassette 107 is detached. Thus, ink will not leak.

When ink cassette 107 is inserted into recording device main body in a direction opposite to arrow X, lever 111 is turned clockwise against the force of spring 113 by virtue of chamfered portion 107A of cassette 107, whereby tube 108 is unblocked. Pin 106 pierces the elastic body of rubber forming coupling portion 115 to provide communication with tube 117 in ink cassette 107. Thus, the recording liquid supply path is open under the state where the recording head and the recording liquid reservoir chamber are connected.

The above-described conventional device has an ink supply path open/close device of a mechanism that seals the supply path by squeezing an elastic tube with the claw portion of an open/close lever. An ink tank formed by vapor-depositing aluminum onto a laminate film in which ink is sealed is provided in the ink cartridge.

The interior of the tank is completely sealed, and suction is required according to a slight negative pressure to supply ink outwards.

As joining means of an ink cartridge in the above-described conventional device, a plug member formed of silicon rubber at the ink cartridge side is urged against the connecting portion (pin) of the head side, whereby the plug member is pierced to be coupled with the tube member within the ink tank.

Simultaneous to this operation, the open/close lever blocking the ink supply path at the head side abuts against the ink cartridge to be turned. The blocking is removed to provide communication of ink in the ink tank and the recording head. Here, the interior of the ink tank is maintained at a pressure not higher than atmospheric pressure to prevent exudation of ink from the nozzle portion of the head.

Since the ink supply path is opened/closed by squeezing an elastic tube with an open/close device in such a conventional ink jet recording device, there is a problem that a crack is generated in the tube when the ink cartridge is frequently exchanged, undesirable from the standpoint of reliability.

The open/close device is opened after the coupling between the ink cartridge and the ink jet recording device main body is completed, and closed just before the ink cartridge is detached from the main body of the ink jet recording device. Therefore, there is a possibility that a bubble in the ink supply path of the coupling portion is urged into the ink cartridge. There is also a possibility that discharge of accumulated bubbles in the ink supply path of the coupling portion is not sufficient. Supply of ink from the ink cartridge to the main body of the ink jet recording device may be deteriorated by such bubbles.

There is also a problem that ink cannot be supplied sufficiently since the opening of piercing the member sealing the connection portion of the ink cartridge with a pin is small.

Furthermore, a great amount of the accumulated bubbles in the coupling portion in the state where the ink cartridge is coupled to the ink jet recording device enters the ink cartridge to degrade or completely stop supply of ink.

SUMMARY OF THE INVENTION

An object of the present invention is to provide an ink jet recording device and an ink cartridge that can have maintenance frequency of a recording head reduced even when the ink cartridge is exchanged frequently.

Another object of the present invention is to provide an ink jet recording device and an ink cartridge that can have ink supplied from the ink cartridge to a recording head stably even when the ink cartridge is exchanged frequently.

A further object of the present invention is to provide an ink jet recording device and an ink cartridge, wherein bubbles remaining in a coupling portion of the ink cartridge are discharged outside without being urged into an ink passage in detaching the ink cartridge.

Still another object of the present invention is to provide an ink jet recording device and an ink cartridge that can have ink supplied from the ink cartridge to a recording head stably even when bubbles remaining at a coupling portion of the ink cartridge enters the ink cartridge in detachment thereof.

A still further object of the present invention is to provide an ink jet recording device and an ink cartridge that can have a great amount of ink supplied from the ink cartridge to a recording head.

According to an aspect of the present invention, an ink jet recording device includes a recording head for discharging ink to a recording medium, and a recording head side supply unit coupled to a reservoir chamber side coupling portion of an ink cartridge for receiving ink supply and providing ink into the recording head. The recording head side supply unit includes a member with an ink passage, and a valve device for opening/closing the ink passage. The valve device begins to open during the coupling of the reservoir chamber side coupling portion with the recording head side coupling portion, and closes upon complete detachment. The valve device includes a piercing member inserted into the ink passage from the bottom side thereof in a vertical-slidable manner, piercing a sealing member during coupling of the reservoir chamber side coupling portion and the recording head side coupling portion to conduct ink flow from the reservoir chamber side coupling portion, and an energizing member for energizing the piercing member upwards. The piercing member has a configuration that closes the ink passage at its most highest position. The recording head side coupling portion further includes a support unit for receiving the reservoir chamber side coupling portion at the completion of coupling with the reservoir chamber side coupling portion. The leading edge of the piercing member has a configuration so that, when the valve device is located at a position where the ink passage is shut, its upper end is located higher than the height of the abutting portion at a state when the elastic sealing member abuts against the support portion.

When the reservoir chamber side coupling portion of the ink cartridge is inserted into the recording head side coupling portion of the ink jet recording device, the piercing member of the valve device provided at the recording head side coupling portion breaks through the sealing member. The upper end portion of the piercing member abuts against the abutting portion of the reservoir chamber side coupling portion. When the reservoir chamber side coupling portion is further inserted, the valve device including the piercing member is pushed downwards, whereby the valve begins to open.

Here, the support unit of the recording head side coupling portion and the elastic sealing member of the reservoir chamber side coupling portion are not yet in contact, and a gap is formed. More specifically, the coupling portion spacing formed by the reservoir chamber side coupling portion and the recording head side coupling portion communicates with the outside via a gap formed by the support unit and the elastic sealing member, and communicates with the inside of the recording head side coupling portion by an ink passage formed between the valve that begins to open and the member.

The bubble remaining in the coupling portion spacing is discharged outwards from the gap formed by the support unit and the elastic sealing member without being forced into the ink passage in the recording head.

When the ink cartridge is to be disconnected for exchange, the volume of the coupling portion spacing formed of the reservoir chamber side coupling portion and the recording head side coupling portion increases as the reservoir chamber side coupling portion moves upwards. Here, the amount of deformation of the elastic sealing member that is elastically deformed at the time of contact is reduced. However, the close contact state of the elastic sealing member and the support unit is maintained until the amount of elastic deformation is zero.

Therefore, the pressure in the coupling portion spacing is reduced, whereby bubbles are drawn out from the ink passage of the recording head side coupling portion. The elastic deformation member is separated from the support unit when the elastic deformation amount becomes zero. Then, the abutting portion becomes remote from the upper end of the protruding member. More specifically, the valve device is closed at a state where there are hardly no bubbles in the ink passage of the recording head side coupling unit.

Even if the ink cartridge is exchanged frequently, ink can be supplied stably from the ink cartridge to the recording head to reduce the frequency of maintenance of the recording head.

Preferably, the recording head side coupling portion further includes a rotary member for rotating the piercing member during the coupling of the recording head side coupling portion and the reservoir chamber side coupling portion. The rotary member includes a base provided at the recording head side coupling portion, having a wall forming a cylindrical bore of an inner ring to support the valve device in a slidable manner. The wall surface includes a guiding slot formed in a spiral manner. The valve device further includes a guiding unit fixed at the bottom of the piercing member, and connected with the guiding slot.

The rotary member rotates the piercing member during the coupling of the recording head side coupling portion and the reservoir chamber side coupling portion. The piercing member forms a hole in the sealing member of the reservoir chamber side coupling portion that is greater than the hole when not rotated. Thus, a greater amount of ink than when the piercing member is not rotated can be supplied from the ink cartridge to the recording head.

According to another aspect of the present invention, an ink cartridge includes an ink reservoir member having an ink reservoir chamber for storing ink, and a reservoir chamber side coupling portion for supplying outwards the ink stored in the ink reservoir chamber. The reservoir chamber side coupling portion includes a sealing member for sealing ink stored in the ink reservoir chamber, an elastic sealing member provided at a position to form close contact with the support unit when the coupling with the recording head side coupling portion is completed, and an abutting portion provided at a position lower than the height of the upper end of the piercing member at its most highest position when the elastic sealing member abuts against the support unit.

Preferably, the ink reservoir member includes a partition formed along the direction of ink flow for dividing the portion where the reservoir chamber side coupling portion is provided from a remaining portion. The partition includes a hole for ink to exude towards the reservoir chamber side coupling portion.

Bubbles remaining in the coupling portion spacing enter the reservoir chamber side coupling portion divided by the partition formed along the ink flow direction to be accommodated at a position higher than the hole through which the ink stored in the ink reservoir chamber is exuded towards the reservoir chamber side coupling portion. Therefore, there are no bubbles in the ink flow path from the ink reservoir chamber to the recording head side coupling portion. Ink can be supplied stably from the ink cartridge to the recording head even when a great amount of bubbles enter the ink cartridge.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
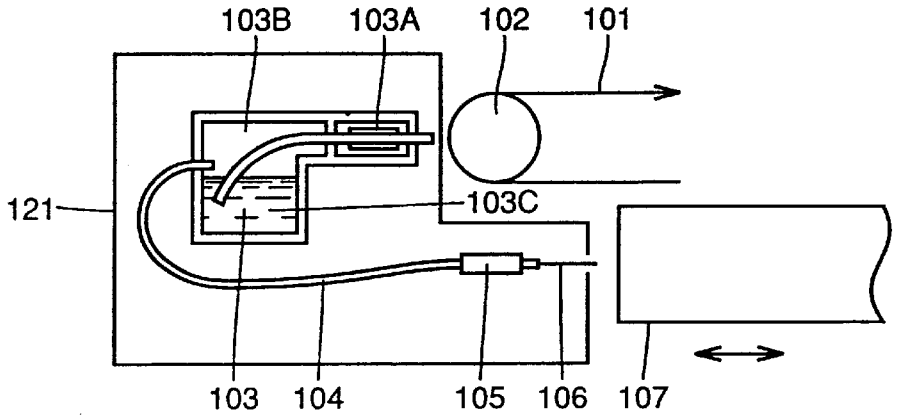
FIG.1 PRIOR ART
FIG. 1 is a schematic diagram of a conventional ink jet recording device and an ink cartridge.
Figure 2:
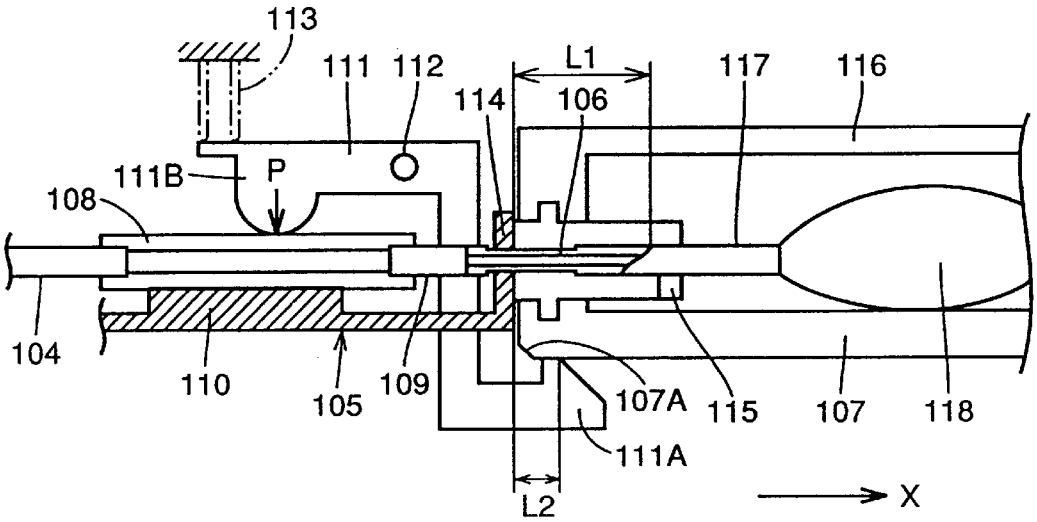
FIG.2 PRIOR ART
FIG. 2 is a sectional view of a coupling portion of a conventional ink jet recording device and an ink cartridge.
Figure 3:
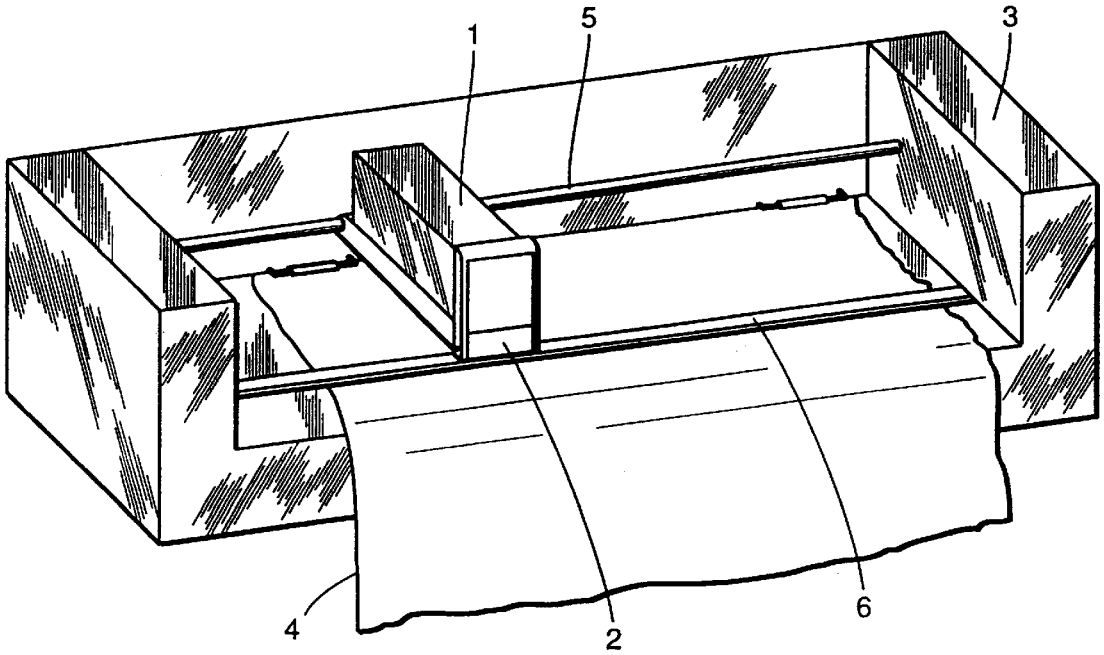
FIG. 3 is a perspective view of main components of an ink jet recording device according to a first embodiment of the present invention.

Referring to FIG. 3, an ink jet recording device includes an ink cartridge 1 for supplying ink to a recording head, a carriage 2 for mounting ink cartridge 1 in a detachable manner, a slide shaft 5 and a slide plate 6 for regulating the scanning direction of cartridge 2, a cabinet 3 for supporting slide shaft 5 and slide plate 6, a recording sheet 4 on which the ink jet recording device records information, and a recording head not shown facing downwards, provided at carriage 2 towards recording sheet 4. FIG. 3 is illustrated with a portion of cabinet 3 removed for the sake of showing the interior of the ink jet recording head.

Figure 4:
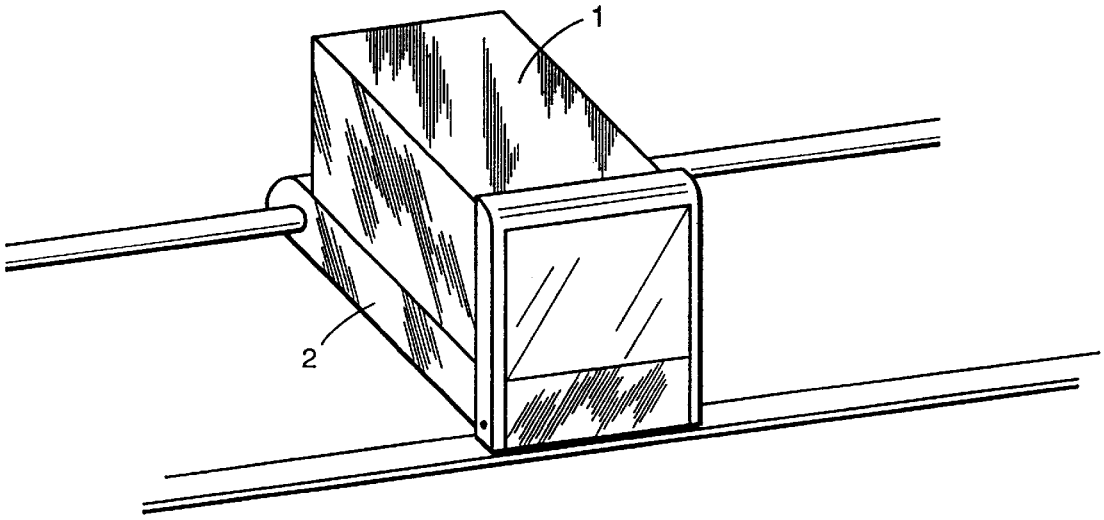
FIG. 4 is a perspective view of an ink cartridge and carriage of the first embodiment.

FIG. 4 is an enlarged perspective view of ink cartridge 1 and carriage 2 of FIG. 3.

Figure 5:
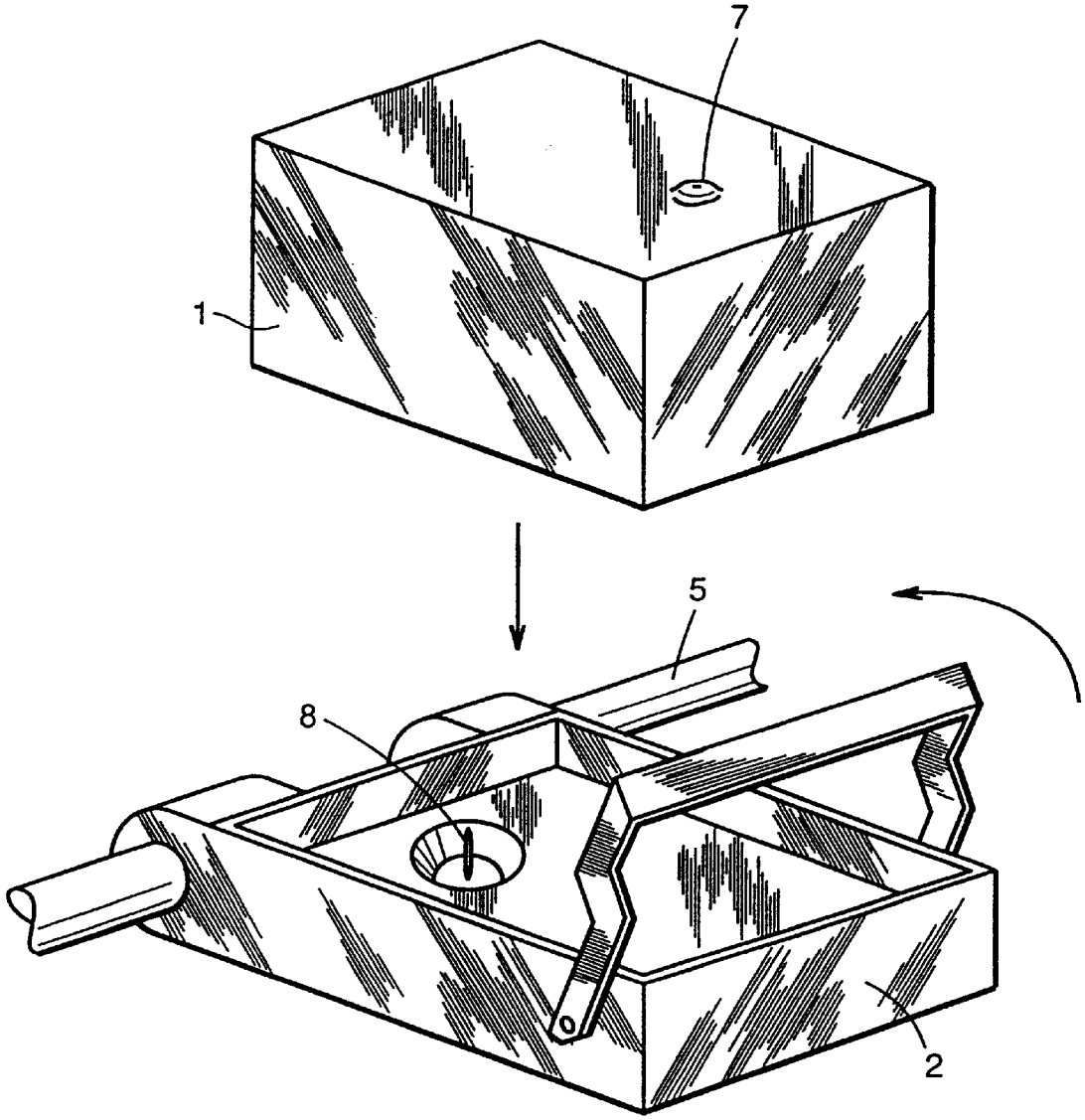
FIG. 5 is a perspective view of the ink cartridge and carriage of the first embodiment prior to attachment.

In FIG. 5, components corresponding to those already described with reference to FIG. 3 have the same reference characters allotted, and detailed description will not be repeated. An air hole 7 of ink cartridge 1 is provided at the upper surface of ink cartridge 1. An ink cartridge side coupling portion (not shown) provided below ink cartridge 1 is inserted so as to abut against a coupling portion valve member 8 provided at the head side.

Figure 6:
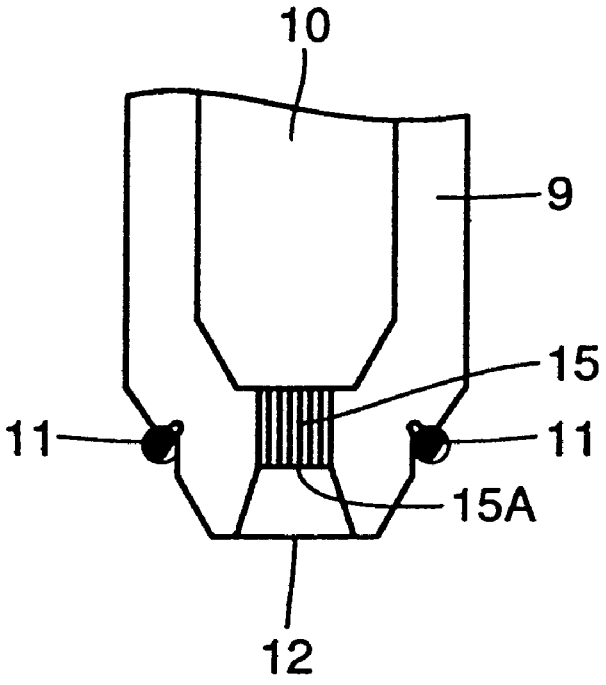
FIG. 6 is a sectional view of an ink cartridge side coupling portion and an head unit side coupling portion of the first embodiment prior to attachment.
Figure 6:
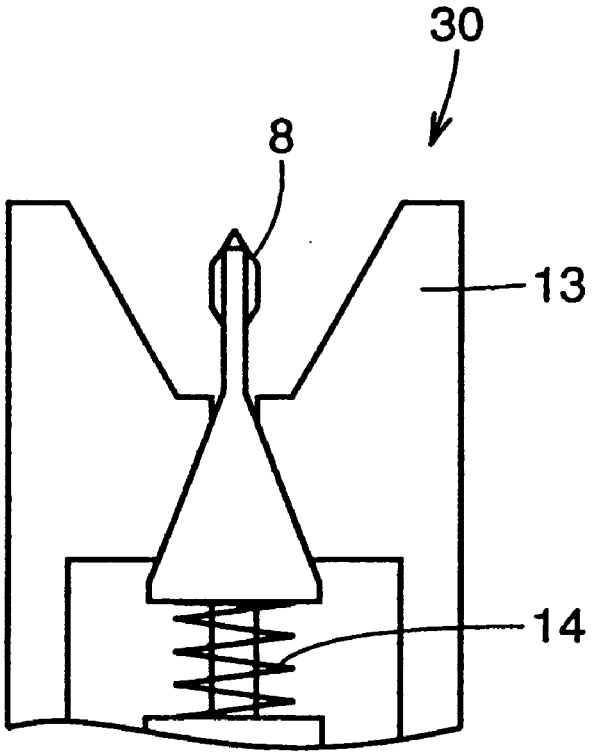

Referring to FIGS. 6 and 5, ink cartridge 1 includes an ink cartridge side coupling portion 9 provided at the carriage 2 side for supplying ink to the recording head. Ink cartridge side coupling portion 9 includes an ink passage 10 filled with recording ink, and a thin tube portion 15 provided at the end of ink passage 10. Ink cartridge side coupling portion 9 further includes a sealing member 12 provided at the leading edge for sealing ink when not in usage, and an elastic O ring 11 provided at a position to form close contact with a recording head side coupling portion 30 when coupled with the recording head. The lower face of thin tube portion 15 forms an abutting portion 15A that will be described afterwards. The recording head includes a recording head side coupling portion 30 coupled with ink cartridge side coupling portion 9 for receiving ink supply. Recording head side coupling portion 30 includes a member 13 having an ink passage, a coupling portion valve member 8 inserted into the ink passage from the bottom side, and having a sword-like tip, and a spring 14 for energizing coupling portion valve member 8 upwards.

The leading end of ink cartridge side coupling portion 9 is covered with sealing member 12 when ink cartridge 1 is not yet attached to the recording head. Ink passage 10 is filled with recording ink. Coupling portion valve member 8 having a sword-like tip is urged towards member 13 of recording head side coupling portion 30 by the energizing force of spring 14, so that the ink passage is completely sealed. The tip of coupling portion valve member 8 is located higher than abutting portion 15A in a state where O ring 11 is in contact with member 13 of head side coupling portion 30 when ink cartridge 1 is attached to the recording head.

Figure 7:
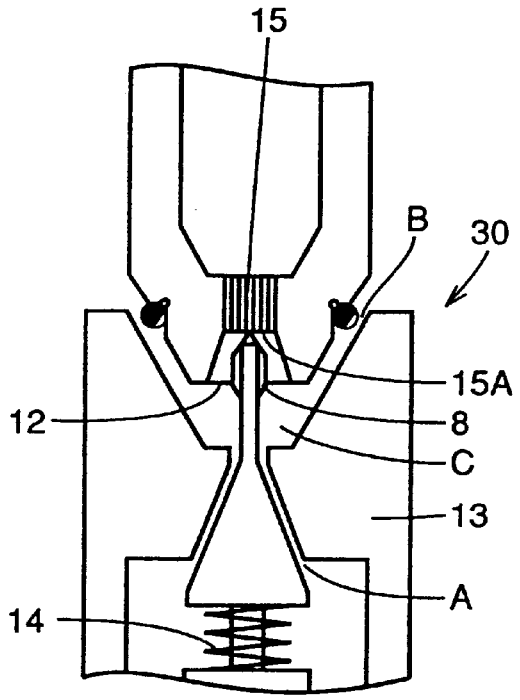
FIG. 7 is a sectional view of the ink cartridge side coupling portion and the head unit side coupling portion of the first embodiment during attachment.

In FIG. 7, components corresponding to those of FIG. 5 have the same reference characters allotted, and their detailed description will not be repeated.

When ink cartridge 1 is inserted into carriage 2, coupling portion valve member 8 pierces sealing member 12 to abut against abutting portion 15A of thin tube portion 15 provided at cartridge side coupling portion 9 of ink cartridge 1. A further insertion of ink cartridge 1 causes coupling portion valve member 8 to be pushed downwards against the energizing force of spring 14, whereby the ink passage of member 13 of head side coupling portion 30 opens.

In this occasion prior to the contact of O ring 11 with member 13 of head side coupling portion 30, ink supply path A of head side coupling portion 30 and spacing B between member 13 and O ring 11 communicate with the exterior and interior of recording head side coupling portion 30. Therefore, a bubble in spacing C between head side coupling portion 30 and ink cartridge side coupling portion 9 is discharged outwards through spacing B between head side coupling portion 30 and O ring 11 without being forced into ink supply path A. The ink flowing out from the penetrated sealing member 12 drops downwards due to gravity to pass through the ink passage of member 13 of head side coupling portion 30 to enter ink supply path A of the recording head side.

Figure 8:
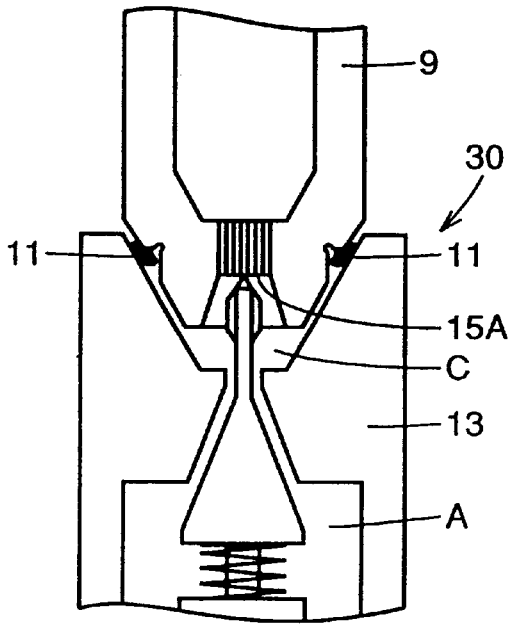
FIG. 8 is a sectional view of the ink cartridge side coupling portion and the head unit side coupling portion of the first embodiment after attachment.

Referring to FIG. 8, O ring 11 is elastically deformed to form close contact with recording head side coupling portion 13 when ink cartridge 1 is completely attached. Here, the bubbles in the ink supply path at the recording head side are attracted into cartridge 1 by the negative pressure therein.

When ink cartridge 1 is pulled out, the volume in spacing C increases as ink cartridge 1 is lifted upwards. Since O ring 11 is not yet completely restored from its elastic deformation state at this time point, the sealing state is maintained. Therefore, the pressure in spacing C is reduced. This causes the Bubbles in ink supply path A of the recording head side to be sucked out via the ink passage of head side coupling portion 30. The elastic deformation amount of O ring 11 becomes zero as ink cartridge 1 is raised upwards. At a further upward movement of ink cartridge 11, the correlation between ink cartridge side coupling portion 9 and head side coupling portion 30 becomes as shown in FIG. 7. Here, air will not flow into ink supply path A of the recording head side through spacing B since spacing C is filled with ink. The state of FIG. 6 (detached state) is attained at a further upward movement of ink cartridge 1. More specifically, coupling portion valve member 8 reliably closes under a state where there are almost no bubbles in the ink supply path of the recording head side by virtue of the energizing force of spring 14.

Figure 9:
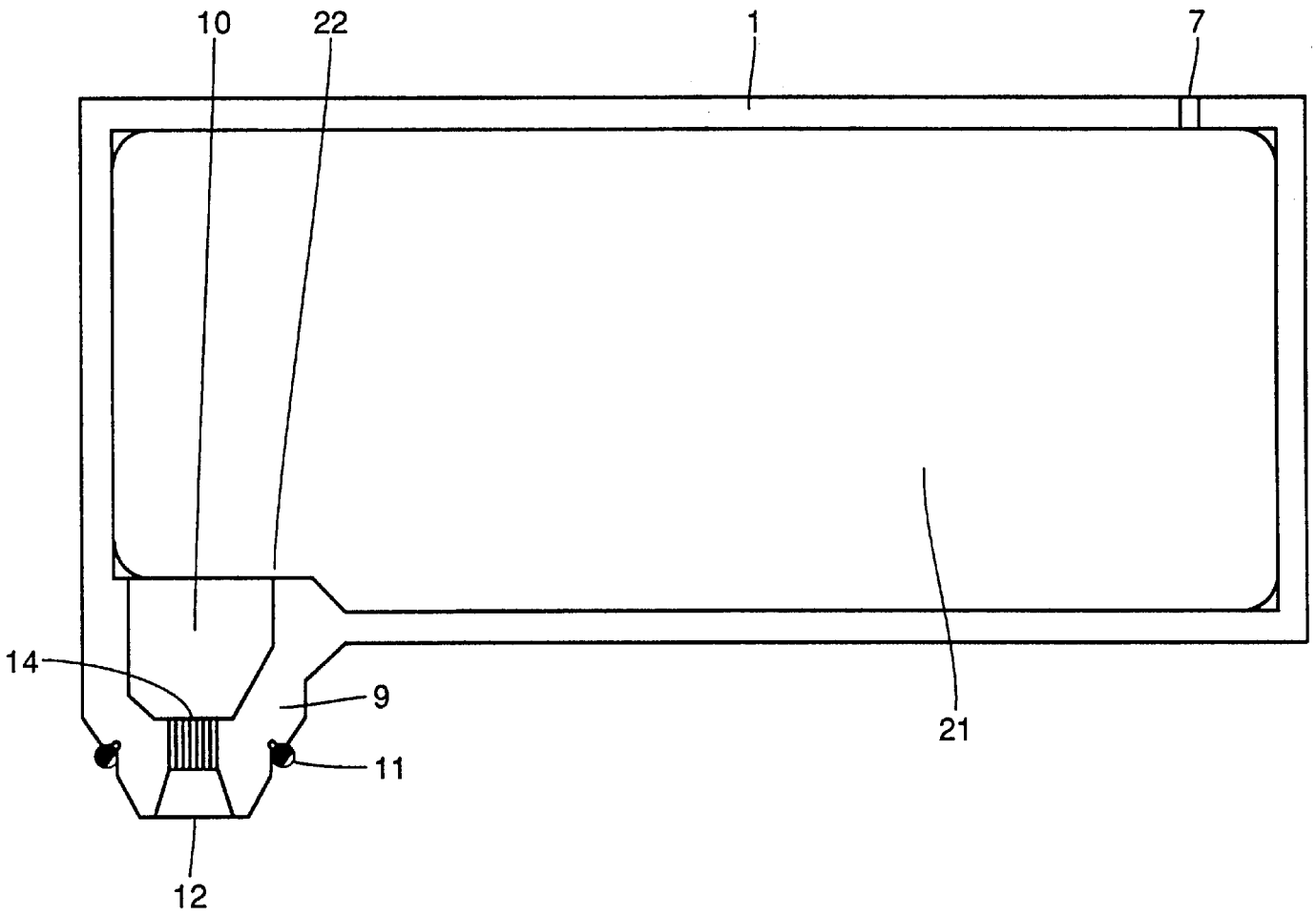
FIG. 9 is a sectional view of an ink cartridge according to the first embodiment.

The entire structure of ink cartridge 1 will be described with reference to FIG. 9. In FIG. 9, components already described with reference to FIGS. 5 and 6 have the same reference characters allotted, and their detailed description will not be repeated. A cartridge ink holding unit 21 filled with a sponge is provided in ink cartridge 1. Ink is maintained by permeating into the sponge. The interior of ink cartridge 1 is divided by mesh 22 into a cartridge ink passage 10 filled with liquid ink and a cartridge ink holding portion 21 including sponge soaked with ink. According to this structure, the ink seeping from the sponge is supplied to ink passage 10.

According to the above-described first embodiment of the present invention, degradation of the member is low since it is not necessary to squeeze the tube to close the ink passage. Reliability of the open/close device can be increased even when the ink cartridge is exchanged frequently. The amount of bubbles forced into the head side coupling portion in coupling the ink cartridge to the recording head side can be reduced. The bubbles accumulated in the coupling portion can be absorbed into ink cartridge 1. The remaining bubbles in the coupling portion can be discharged outwards at the time of detachment. Since the flow of bubbles into the ink supply path is substantially eliminated, reliability of the head is increased and the frequency of head maintenance can be reduced.

Furthermore, attachment of an ink cartridge is facilitated since the sealing portion of the ink cartridge side does not have to be taken off manually. The structure of the coupling portion of the ink cartridge can be more simplified than that used in a conventional device.

Second Embodiment

The ink jet recording device according to a second embodiment of the present invention differs from the ink jet recording device of the first embodiment in that the coupling portion valve member of the recording head side is rotated during coupling of the ink cartridge side coupling portion and the recording head side coupling portion, and that a structure is provided in which a great amount of bubble can be stored in the ink cartridge.

Figure 10A:
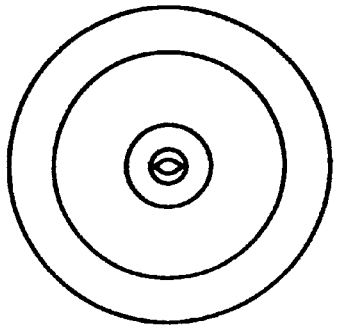
FIG. 10A is a plan view of a head side coupling portion according to a second embodiment of the present invention prior to attachment.
Figure 10B:
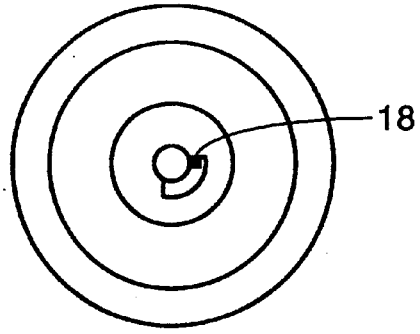
FIGS. 10B and 10C are sectional views of the head side coupling portion of the second embodiment prior to attachment.
Figure 10C:
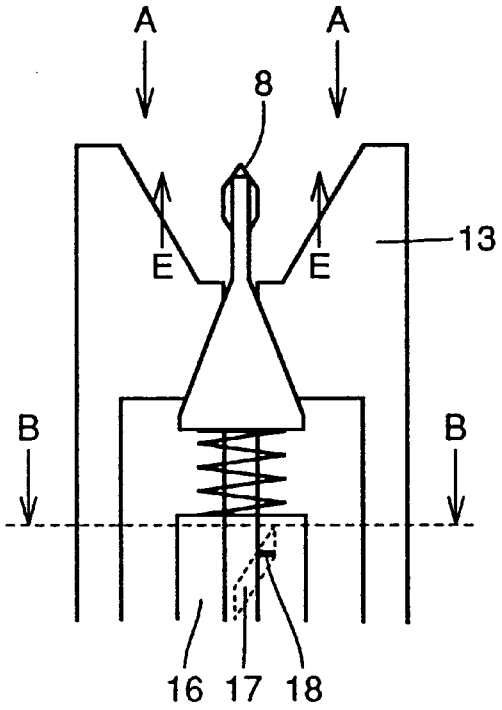

Referring to FIGS. 10A, 10B, and 10C, coupling portion valve member 8 at the recording head side is provided in a slidable manner to a base 16 having a slide hole of a cylindrical bore. A guiding slot 17 is formed in base 16. A guiding unit 18 is formed at the sliding portion of coupling portion valve member 8 so as to engage with guiding slot 17. Guiding slot 17 is formed in a spiral manner with respect to the cylindrical slide hole.

Figure 11A:
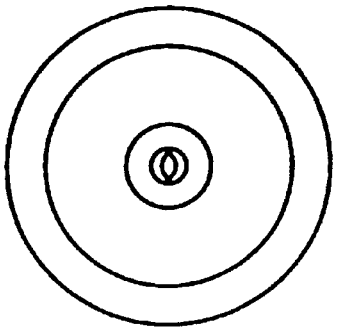
FIG. 11A is a plan view of the head side coupling portion of the second embodiment after attachment.
Figure 11B:
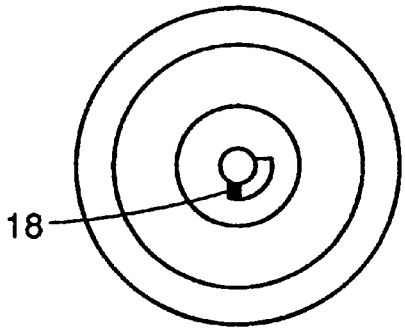
FIGS. 11B and 11C are sectional views of the head side coupling portion of the second embodiment after attachment.
Figure 11C:
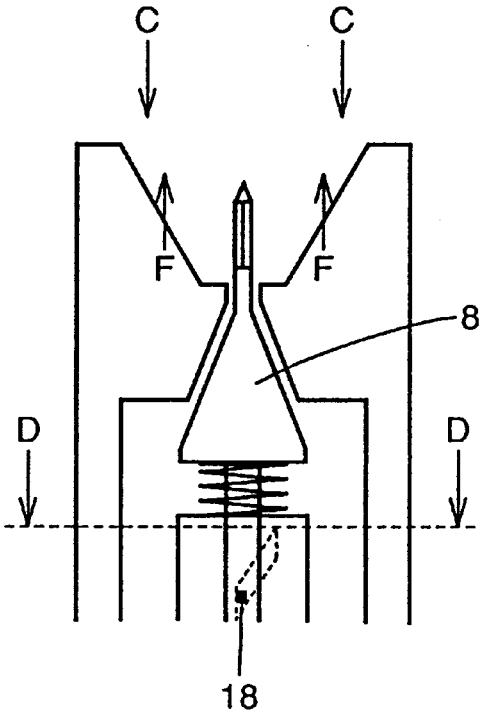

Referring to FIGS. 11A, 11B and 11C, an abutting portion 15A of ink cartridge side coupling portion 9 urges coupling portion valve member 8 of the recording head side downward in the process of attaching ink cartridge 1. Here, guiding pin 18 moves in engagement with guiding slot 17 formed in a spiral manner, whereby coupling portion valve member 8 of the recording head side is urged downwards in a rotating manner.

Here, a structure is shown where coupling portion valve member 8 is rotated approximately 90° at completion of the coupling operation. By virtue of rotation of coupling portion valve member 8 at the time of coupling, a hole can be formed in sealing member 12 of ink cartridge side coupling portion 9 of a size greater than that when not rotated.

Figure 12:
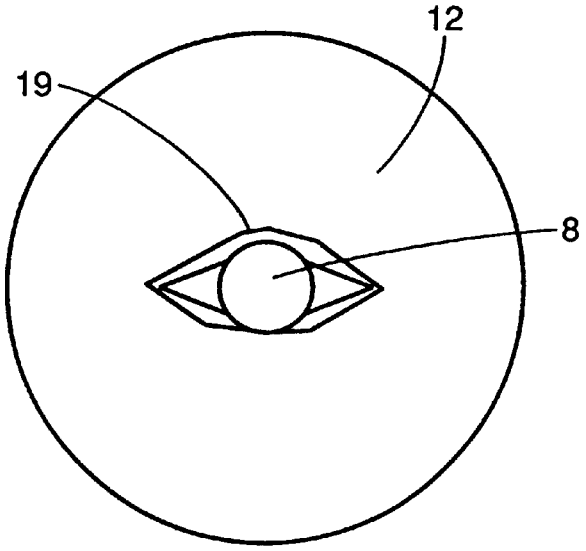
FIGS. 12 and 13 are sectional views of the head side coupling portion of the second embodiment before and after attachment, respectively.
Figure 13:
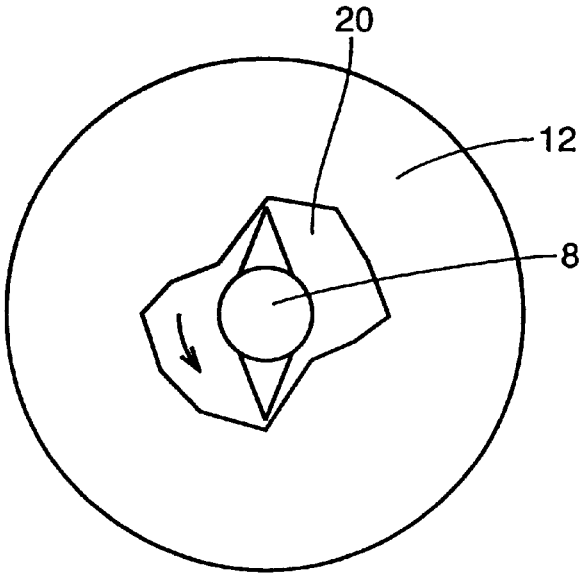

In FIGS. 12 and 13, components corresponding to those of FIG. 6 have the same reference characters allotted, and detailed description thereof will not be repeated.

FIG. 12 shows a hole 19 formed in sealing member 12 when coupling portion valve member 8 is not rotated. FIG. 13 shows a hole 20 formed in sealing portion 12 when coupling portion valve member 8 is rotated 90°. A hole 20 extremely greater than hole 19 can be formed when coupling portion valve member 18 is rotated 90°. Thus, a great amount of ink can be supplied from ink cartridge 1 to the recording head.

Figure 14:
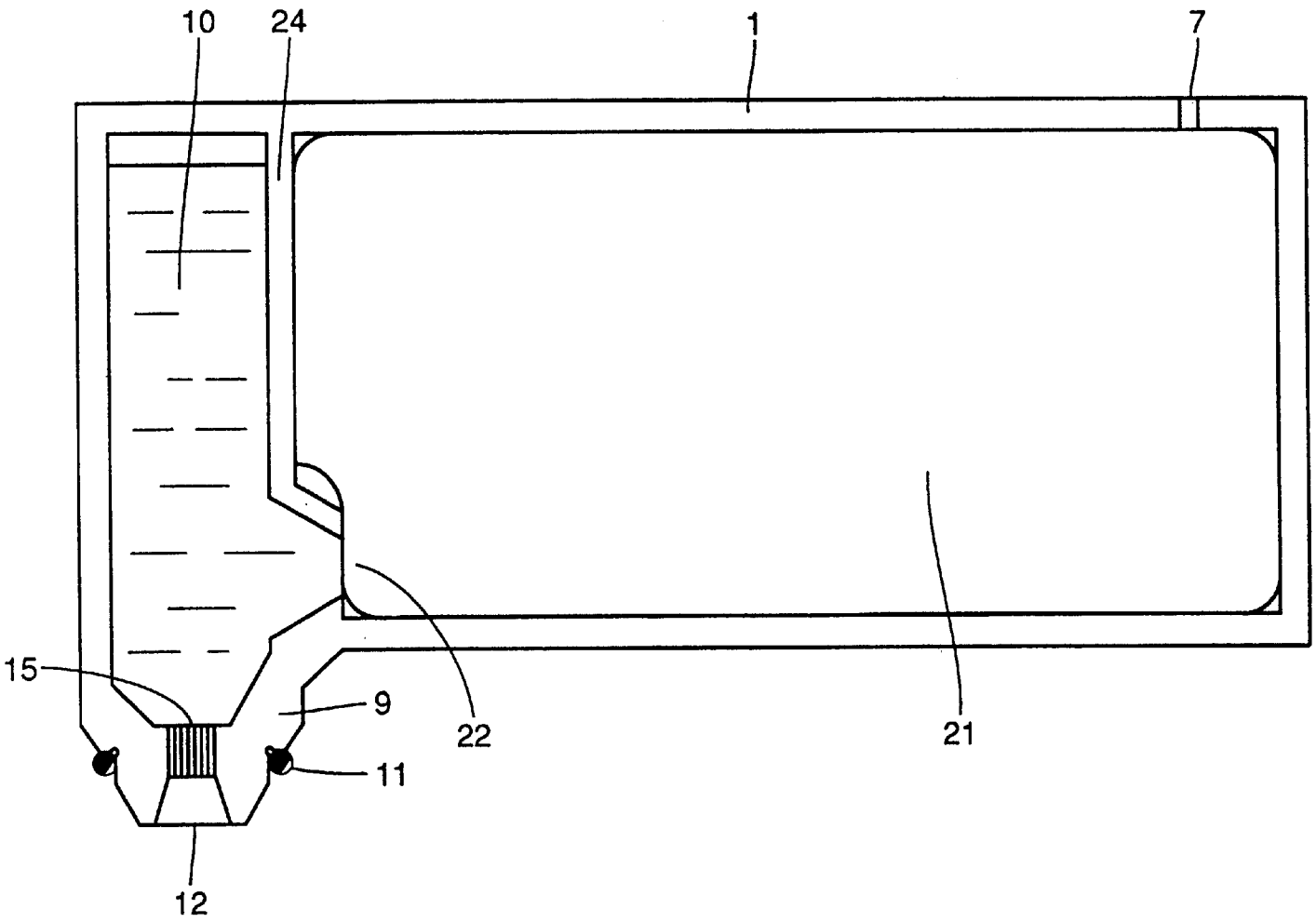
FIG. 14 is a sectional view of an ink cartridge according to the second embodiment.
Figure 15:
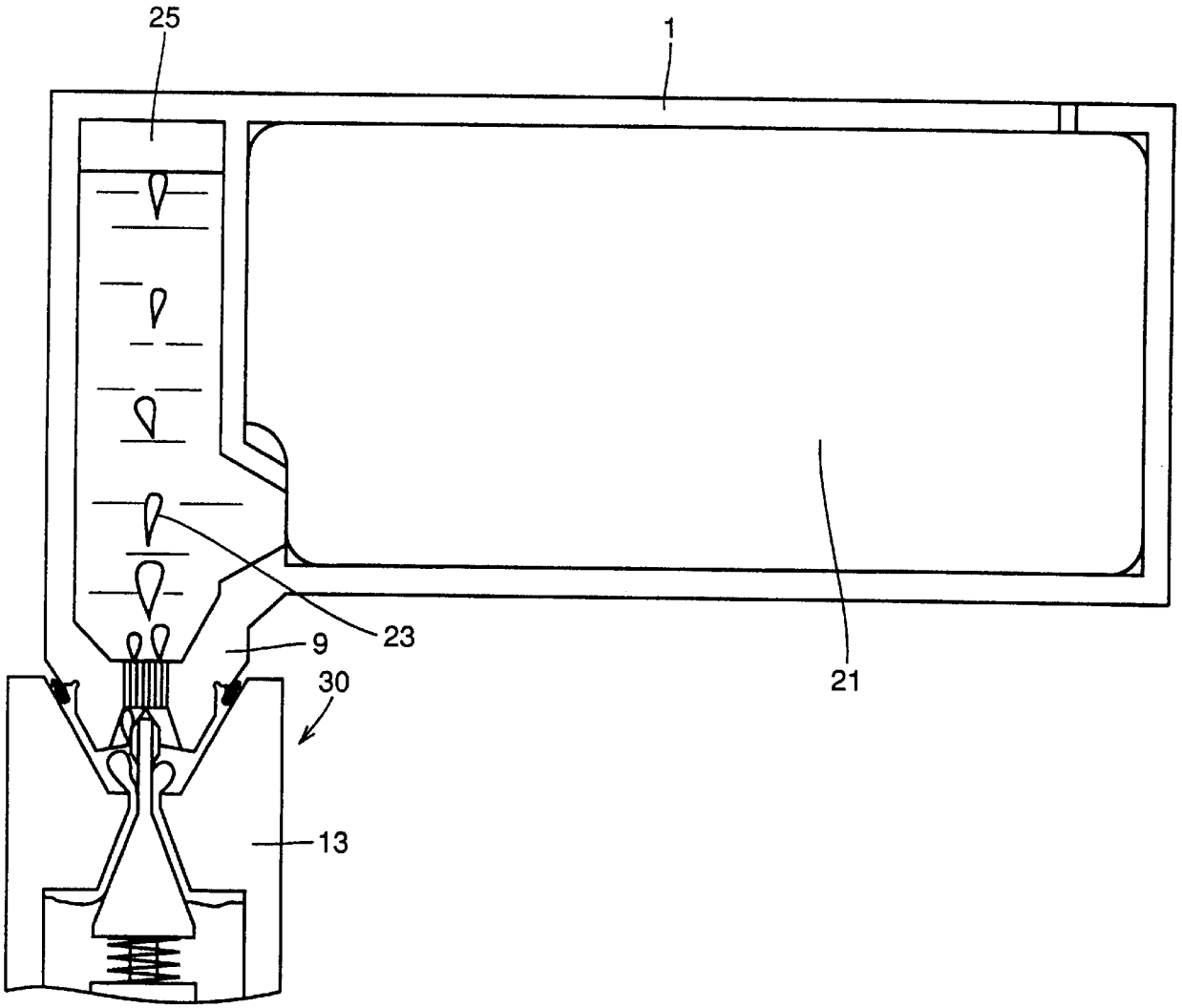
FIG. 15 is a sectional view of an ink cartridge and a head side coupling portion right after the ink cartridge is coupled to the head side coupling portion of the second embodiment.

In FIGS. 14 and 15, components corresponding to those of FIG. 9 described in the first embodiment have the same reference characters allotted, and detailed description thereof will not be repeated.

Ink cartridge 1 includes a partition 24 for dividing cartridge ink passage 10 and cartridge ink holding portion 21. A great amount of bubbles can be trapped by increasing the volume of cartridge ink passage 10 in which bubbles entering from the coupling portion are captured.

Referring to FIG. 15, at the time when ink cartridge side coupling portion 9 of ink cartridge 1 and head side coupling portion 30 are coupled, bubbles 23 in the ink supply path of the recording head are attracted into ink cartridge 1 by the negative pressure in cartridge ink holding portion 21 to be stored in a bubble storage unit 25.

The second embodiment of the present invention provides effects set forth in the following in addition to the effect of the first embodiment. Since the opening of the sealing portion is increased, a great amount of ink can be supplied from the ink cartridge to the recording head. A multi-nozzle head or a high speed head can be mounted in an ink jet recording device. Also, reliability of the head is increased since bubbles remaining in the recording head side coupling portion can be reliably captured in a bubble storage unit in the ink cartridge in exchanging an ink cartridge. The frequency of the head maintenance can be reduced and reliability of the ink cartridge can be increased.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet recording device to which an ink cartridge is attached, the ink jet cartridge including an ink reservoir member having a non-flexible ink reservoir chamber, the ink reservoir chamber being unobstructed, for storing ink totally in the ink reservoir chamber and a reservoir chamber side coupling portion for supplying ink stored in said ink reservoir chamber outwards, said ink jet recording device comprising:

a recording head for discharging ink to a recording medium, and a recording head side coupling portion for receiving ink supplied from said reservoir chamber side coupling portion, so that the ink is supplied to said recording head, wherein said recording head side coupling portion comprises a member with an ink passage with a means for sealing the ink passage, and a valve device for opening and closing said ink passage, wherein said valve device begins to open the ink passage during coupling of said reservoir chamber side coupling portion and said recording head side coupling portion, and closes the ink passage after complete detachment of said reservoir chamber side coupling portion and said recording head side coupling portion.

2. The ink jet recording device according to claim 1, wherein said reservoir chamber side coupling portion comprises a sealing member for sealing the ink stored in said ink reservoir chamber when not in usage, wherein said valve device comprises a piercing member inserted into said ink passage from a lower side thereof in a vertical slidable manner for penetrating said sealing member during coupling of said reservoir chamber side coupling portion and said recording head side coupling portion to conduct ink flow from said reservoir chamber side coupling portion, and energizing means for energizing said piercing member upwards, wherein said piercing member has includes means for shutting said ink passage at a highest operating position of the piercing member.

3. The ink jet recording device according to claim 1, wherein the ink reservoir has an inwardly tapered shape adjacent said coupling portion.

4. The ink jet recording device according to claim 3, wherein the coupling portion has an outwardly tapered shape for connection to the ink reservoir chamber.

5. The ink jet recording device according to claim 1, wherein the coupling portion has an outwardly tapered shape.

6. The ink jet recording device according to claim 5, wherein an outer surface of the ink reservoir chamber has an O shaped sealing ring for contact with the coupling portion.

7. The ink jet recording device according to claim 5, wherein an outer surface of the ink reservoir chamber has an O shaped sealing ring for the contact with the coupling portion.

8. The ink jet recording device according to claim 1, wherein an outer surface of the ink reservoir chamber has an O shaped sealing ring for contact with the coupling portion.

9. An ink jet recording device to which an ink cartridge is attached, the ink jet cartridge including an ink reservoir member having an ink reservoir chamber for storing ink and a reservoir chamber side coupling portion for supplying ink stored in said ink reservoir chamber outwards, said ink jet recording device comprising:

a recording head for discharging ink to a recording medium, and a recording head side coupling portion for receiving ink supplied from said reservoir chamber side coupling portion so that ink is supplied to said recording head, wherein said recording head side coupling portion comprises a member with an ink passage with a means for sealing the ink passage, and a valve device for opening and closing said ink passage, wherein said valve device begins to open the ink passage during coupling of said reservoir chamber side coupling portion and said recording head side coupling portion, and closes the ink passage after complete detachment of said reservoir chamber side coupling portion and said recording head side coupling portion, the means for sealing seals the ink stored in said ink reservoir chamber when not in usage, wherein said valve device comprises a piercing member inserted into said ink passage from a lower side thereof in a vertical slidable manner for penetrating said sealing member during coupling of said reservoir chamber side coupling portion and said recording head side coupling portion to conduct ink flow from said reservoir chamber side coupling portion, and energizing means for energizing said piercing member upwards, wherein said piercing member includes means for shutting said ink passage at a highest operating position of the piercing member, said recording head side coupling portion further comprises a support unit for receiving said reservoir chamber side coupling portion at completion of coupling with said reservoir chamber side coupling portion, wherein said reservoir chamber side coupling portion further comprises an abutting portion provided at a position for commencing abutment with a tip end of said piercing member during coupling of said reservoir chamber side coupling portion and said recording head side coupling portion, and an elastic sealing member provided at a position to form close contact with said support unit at the completion of coupling of said reservoir chamber side coupling portion and said recording head side coupling portion, wherein said piercing member has a tip shape upper end so that, when said piercing member is located at a position shutting said ink passage, its upper end is located higher than a height of said abutting portion of a state where said elastic sealing member forms contact with said support unit.

10. The ink jet recording device according to claim 9, wherein said recording head side coupling portion further includes rotary means for rotating said piercing member during coupling of said recording head side coupling portion and said reservoir chamber side coupling portion.

11. The ink jet recording device according to claim 10, wherein said rotary means comprises a base provided at said recording head side coupling portion, and having a wall surface forming a cylindrical bore defining a means for supporting said valve device in a slidable manner, said wall surface including a guiding slot formed in a spiral manner, wherein said valve device further comprises a guiding unit fixed at a bottom of said piercing member, and engaging with said guiding slot.

12. An ink cartridge attached to an ink jet recording device including a recording head for discharging ink to a recording member, and a recording head side coupling portion receiving ink supply and for supplying ink to said recording head, said ink cartridge comprising:

an ink reservoir member including an ink reservoir chamber for storing the ink, a reservoir chamber side coupling portion for supplying the ink stored and located in said ink reservoir chamber to the outside of the reservoir chamber side portion, wherein said reservoir chamber side coupling portion comprises a sealing member in an ink passage for sealing ink stored in said ink reservoir chamber, wherein said recording head side coupling portion comprises a valve device for opening/closing the ink passage, a support unit for receiving said reservoir chamber side coupling portion at completion of coupling with said reservoir chamber side coupling portion, wherein said valve device comprises a piercing member, with an end defining a highest position, provided at an edge portion of said valve device at the ink cartridge side in a vertical slidable manner for piercing said sealing member during coupling of said reservoir chamber side coupling portion and said recording head side coupling portion to extract ink from said reservoir chamber side coupling portion, wherein said reservoir chamber side coupling portion further comprises an elastic sealing member provided at a position to form close contact with said support unit at completion of coupling of said reservoir chamber side coupling portion and said recording head side coupling portion, and an abutting portion provided so as to be located, when said elastic sealing member abuts against said support unit, lower than the height of an upper edge portion of said piercing member at its highest position.

13. The ink cartridge according to claim 12, wherein said ink reservoir member comprises a partition formed along an ink flowing direction for dividing a portion of the ink reservoir member where said reservoir chamber side coupling portion is provided from a remaining portion of the ink reservoir chamber, wherein said partition comprises a hole through which the ink stored in said ink reservoir chamber exudes to said reservoir chamber side coupling portion.

14. The ink jet head according to claim 12, wherein said ink reservoir member comprises a partition formed along a bottom of said ink reservoir chamber for dividing a portion of the ink reservoir member where said reservoir chamber side coupling portion is provided from a remaining portion of the ink reservoir member, wherein said partition includes a hole through which the ink stored in said ink reservoir chamber exudes to said reservoir chamber side coupling portion.

* * * * *